US005238330A

United States Patent [19]

Plevak et al.

[11] Patent Number: 5,238,330

[45] Date of Patent: Aug. 24, 1993

[54] DISPLACEABLE MINE ROOF SUPPORT ASSEMBLIES

[75] Inventors: Lubomir Plevak; Gunter Lagodka, both of Lunen; Michael Schiller, Werne, all of Fed. Rep. of Germany

[73] Assignee: Westfalia Becorit Industrietechnik GmbH, Fed. Rep. of Germany

[21] Appl. No.: 806,148

[22] Filed: Dec. 12, 1991

[30] Foreign Application Priority Data

Dec. 22, 1990 [DE] Fed. Rep. of Germany ..... 4041527

[51] Int. Cl.[5] ..... E21D 23/08; E15D 15/44

[52] U.S. Cl. ..... 405/295; 405/296; 405/299

[58] Field of Search ..... 405/291-301; 299/33

[56] References Cited

U.S. PATENT DOCUMENTS 4,568,222 2/1986 Hill ..... 405/299
4,978,248 12/1990 Sprenger et al. ..... 405/291 X
5,039,257 8/1991 Bithell ..... 405/299 X

FOREIGN PATENT DOCUMENTS 3317801 11/1984 Fed. Rep. of Germany .
3422387 1/1985 Fed. Rep. of Germany .
3625826 3/1987 Fed. Rep. of Germany .
3713887 11/1988 Fed. Rep. of Germany .
2180285 3/1987 United Kingdom ..... 405/299

*Primary Examiner*—Dennis L. Taylor
*Assistant Examiner*—Arlen L. Olsen
*Attorney, Agent, or Firm*—Samuels, Gauthier & Stevens

[57] ABSTRACT

A mine roof support frame has a pair of spaced-apart floor skids on which hydraulic props support a roof engaging structure. A shifting mechanism with a ram in a trough-like housing and a guide beam is positioned between the skids and serves to displace the frame relative to a scraper-chain conveyor and vice versa. The guide beam is a flat plate with a width more or less the same as the space between the skids and rests directly on the floor. The piston rod of the ram is coupled to the guide beam near the conveyor, the ram cylinder is coupled to the housing and the housing is coupled to the skids at the stowage end. The ram housing has a guide rail on the underside which mates with a guide element on the top of the guide beam. Levers pivotably coupled to the floor sills in front of the ram housing are operated by piston and cylinder units to engage on the guide beam to lift the floor skids partially during advancement of the frame.

17 Claims, 4 Drawing Sheets

DISPLACEABLE MINE ROOF SUPPORT ASSEMBLIES

FIELD OF THE INVENTION

The present invention relates to a mine roof support assembly or frame.

BACKGROUND TO THE INVENTION

Support frames are known for use in mineral mine workings which are composed of hydraulic props connected between roof and floor-engaging structures and a goaf shield pivotably connected between the roof and floor engaging structures. To advance the frame from time to time, and to advance a scraper-chain conveyor of an associated mine installation, it is known to operate a shifting mechanism connected between the floor-engaging structure of the frame and the conveyor. The shifting mechanism can conveniently take the form of an hydraulic ram and a guide beam positioned in a space between a pair of skids or sills forming the floor-engaging structure. When the frame is being shifted, the props are relieved and the ram of the shifting mechanism is operated to draw up the frame towards the conveyor. The guide beam then ensures the sills of the frame do not deviate from the desired path.

Support frames of the above-mentioned kind are known in various designs. In support frames described in DE-3317801 and DE-3713887 the guide beam is made up from several parallel resilient bars guided on lugs of a trough in which the shifting ram is accommodated. The bars are disposed at some distance above the floor and are connected together with a head piece and linked therewith to the conveyor. Guide beams with a flat profile are also known.

To facilitate shifting of the frame on the floor of the working, it is known to use a device which partially raises the floor sills during the movement of the frame. The operation of this device enables the sills to be released if they have become embedded in the floor and facilitates the sliding of the sills over the floor. Support frames employing such lifting devices are known for example from U.S. Pat. No. 4568222 and DE 3625826.

In these frames, the guide beam connected to the conveyor lies in the space between the floor sills and forms an abutment for the lifting devices. Often the lifting devices are operated in direct dependence on the shifting ram and control of the sills independent of the shifting ram is not possible in this case. Furthermore, part of the structure of the shifting ram is needed to operate the lifting device.

U.S. patent application Ser. No. 07/744368 (DE-OS 4027087.4) describes a frame with a modified lifting device with which the floor sills or skids can be lifted by a separate unit or units quite independent of the ram. In this frame, the piston rod of the ram is connected to the end of the guide beam remote from the mineral face so that when the rod is retracted the conveyor is displaced and when the rod is extended the frame is shifted up.

An object of the invention is to provide an improved support frame in which the guide beam and the lifting device can be arranged in a compact efficient manner allowing the floor skids to be lifted in a controlled way with the forces transferred to the floor via the guide beam without tilting or jamming despite unevenness in the floor.

SUMMARY OF THE INVENTION

According to the invention there is provided a mine roof support frame comprising a roof-engaging structure, a floor-engaging structure, hydraulic prop disposed between the roof and floor-engaging structures, and a shifting mechanism with a guide beam and an hydraulic ram for displacing the frame; wherein the guide beam is connectable to a shiftable abutment, such as a conveyor, the floor-engaging structure is composed of a pair of side-by-side elongate sills spaced apart to produce a space therebetween with the shifting mechanism being located in the space between the floor sills, a housing is provided for the ram of the shifting mechanism and at least partly surrounds said ram, the guide beam is disposed beneath the ram housing and is positioned to rest on the floor of a mine working during use, guide means serves to guide the ram housing and the guide beam for relative movement predominantly longitudinally of the floor sills, while permitting vertical and tilting adjustments between the guide beam and the ram housing and connection means connects the ram, preferably the piston rod thereof, to the ram housing and the ram, preferably the cylinder thereof, to the guide beam. The ram housing can be a simple U-shaped trough open at the top.

The shifting ram can advance the frame in a step like incremental manner as known per se. Since the guide beam rests on the floor it directly transfers forces created by partial lifting of the floor sills and/or shifting to the floor. However, due to the special nature of the guide means between the guide and the housing or trough for the ram, the guide beam and the housing can adjust themselves in the vertical and transverse orientations quite independently yet without impeding the mutual guide function to adapt to unevenness in the floor. No jamming or tilting can thus occur and the guide beam and the ram housing are fully guided during the shifting movements.

The shifting mechanism can be designed on quite simple lines and is largely proof against contamination.

A lifting device can be provided for partial lifting of the floor sills from time to time and particularly when the frame is to be displaced by the shifting mechanism. The lifting device can be designed in a simple compact manner. Preference is given to a construction which has a toggle or angle lever pivotable in a plane parallel to the floor sills of which one arm is actuated by a piston and cylinder unit whilst the other arm acts on the guide beam. The guide beam is preferably a flat plate engaging on the floor substantially over the full width of the gap between the floor sills.

It is advisable to couple the floor sills together in the rear zone remote from the mineral face so they can more readily be adjusted in the vertical sense at the front region. One of the lifting levers and an associated actuator unit can be provided on each floor sill, preferably on the sides facing inwards. The levers may swing alongside the ram or the housing thereof. Pivot bearings or joints for the levers are best positioned on the sills in front of the ram housing and above the guide beam.

A modified support frame in accordance with the invention omits the lifting device but is nonetheless useful in that the improved guide connection between the guide beam and the ram housing of itself enables the sills to adjust to unevenness in the floor.

Preferably the guide means between the guide beam and ram housing comprises a longitudinal guide rail disposed at the central region of the space or gap between the floor sills which rail is trapped within a guide element. The rail can have a T-shaped crosssectional profile with a head located in a claw-like guide element. Adequate clearance is present between the rail and the guide element to permit mobility sufficient to cope with the adjustments needed during operation.

The guide rail may be provided on the bottom of the housing or trough receiving the ram and the guide element on the upper side of the guide beam or vice versa. The guide rail need only extend over part of the length of the ram housing near the mineral face so long as the guide rail is held in the guide element for the entire stroke of the shifting ram.

The invention may be understood more readily, and various other aspects and features of the invention may become apparent, from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENTS

Figure 1:
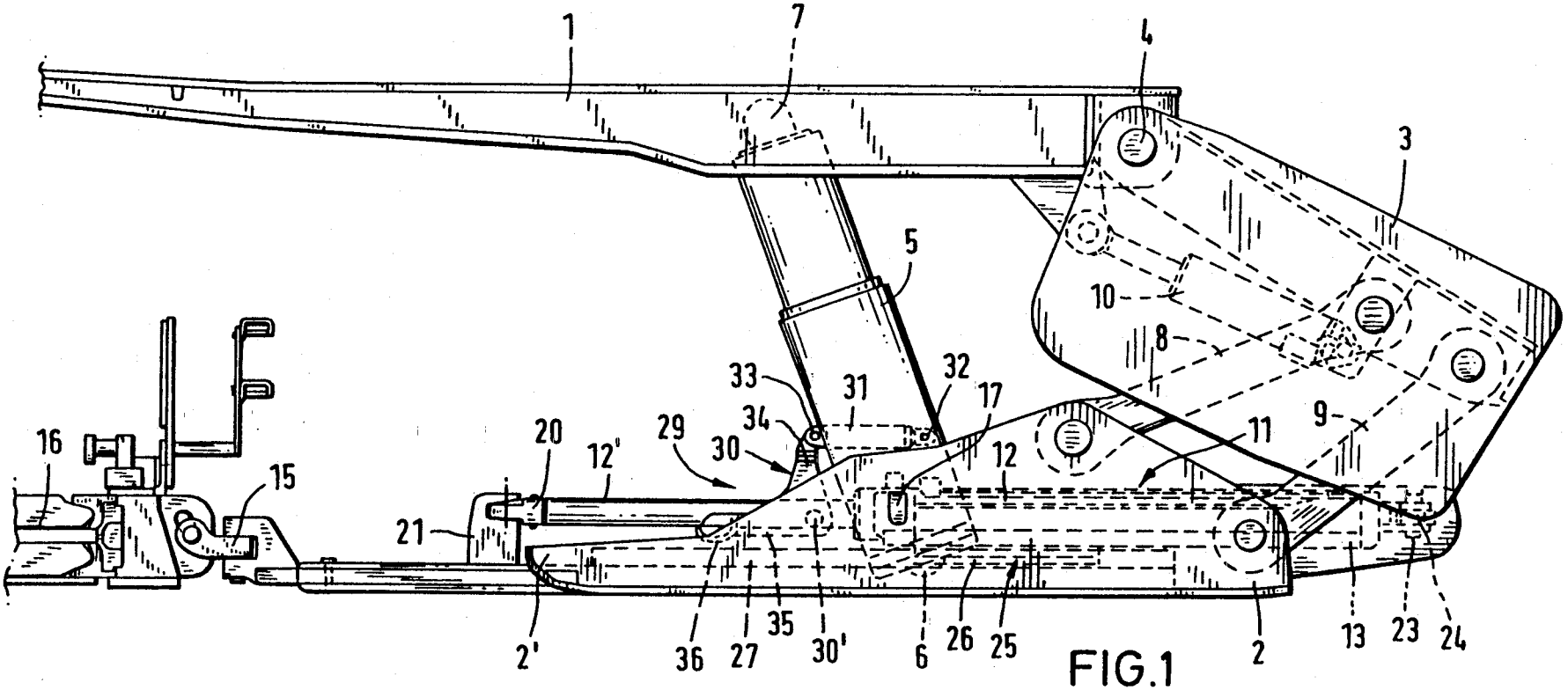
FIG. 1 is a schematic side view of a support frame and part of a mining installation constructed in accordance with the invention.
Figure 2:
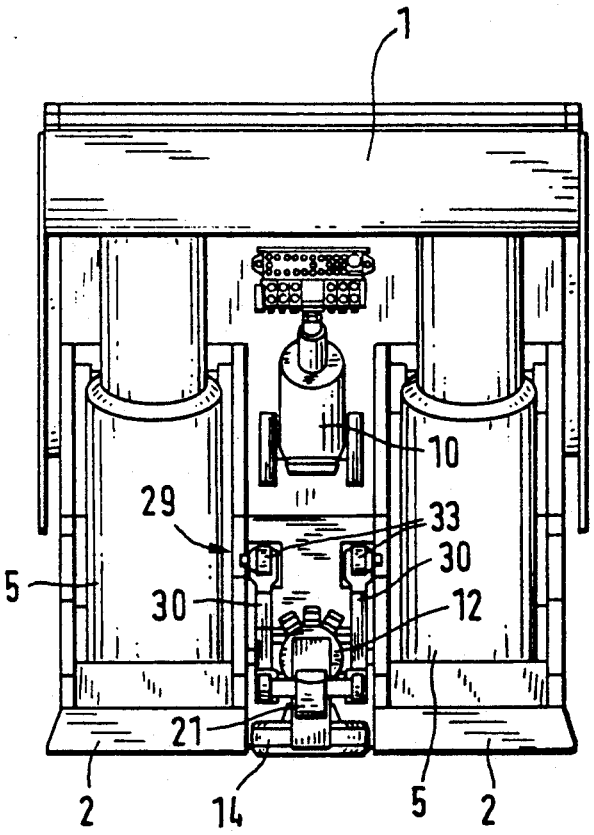
FIG. 2 is an end view of the support frame shown in FIG. 1 as viewed from the mineral face.
Figure 3:
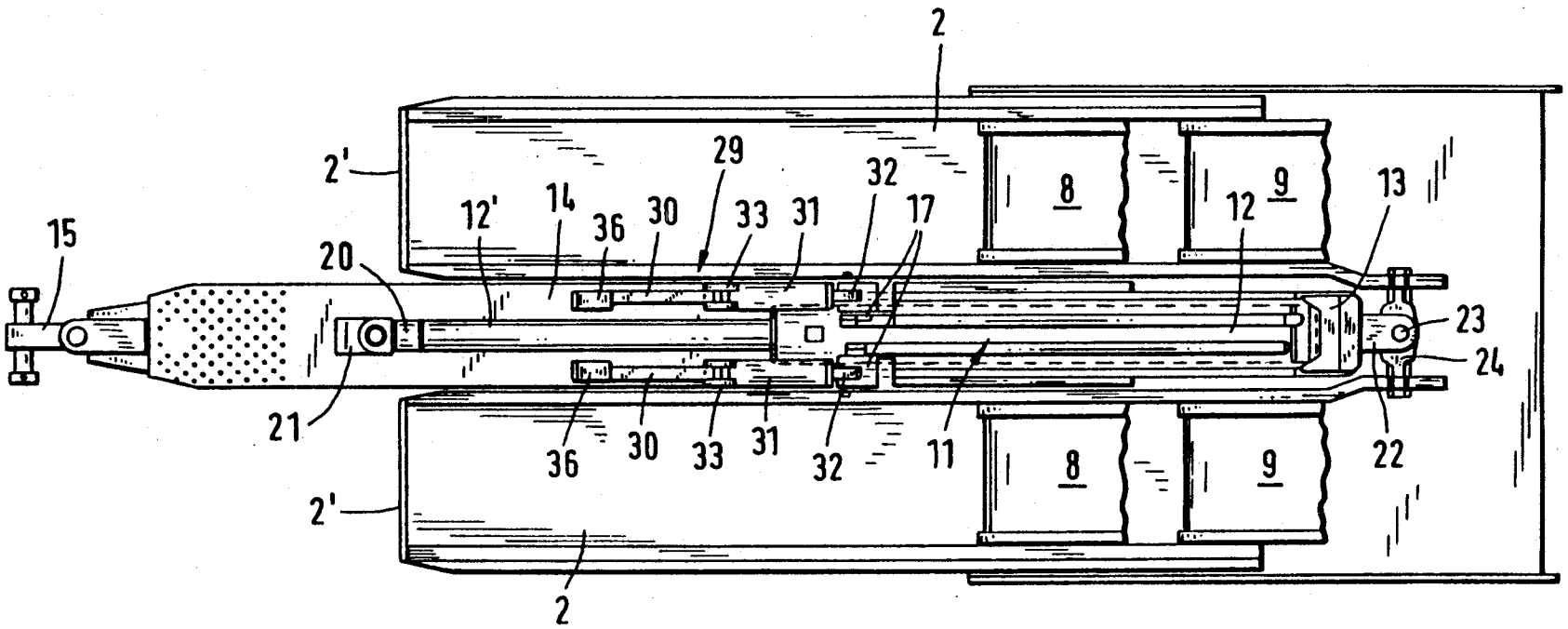
FIG. 3 is a plan view of the lower region of the frame shown in FIGS. 1 and 2.

FIGS. 1 to 3 of the accompanying drawings depict a mine roof support assembly or frame constructed in accordance with the invention. The frame is composed of a floor-engaging structure, a roof-engaging structure 1 and hydraulic props 5 articulated therebetween with joints 6, 7. The floor-engaging structure is sub-divided into a pair of floor sills or skids 2. A goaf shield 3 is connected to the rear end of the roof-engaging structure 1 with one or more pivot joints 4. The shield 3 is connected to the floor sills 2 with the aid of pivotable guide levers 8,9 which are designed as the so-called lemniscate guide linkage known per se. A piston—and—cylinder 10 is pivotably mounted between the shield 3 and the roof-engaging structure 1.

The floor sills 2 are normally orientated parallel to one another but the sills 2 are able to adjust themselves vertically to some extent to cope with uneven regions in the floor of the mine working.

Figure 4:
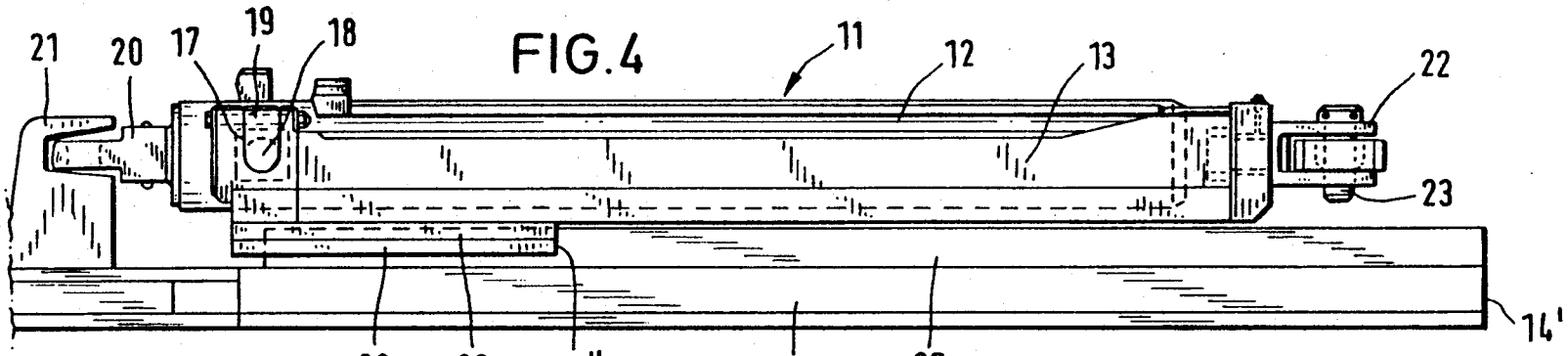
FIG. 4 is a side view of the shifting mechanism of the support frame.
Figure 5:
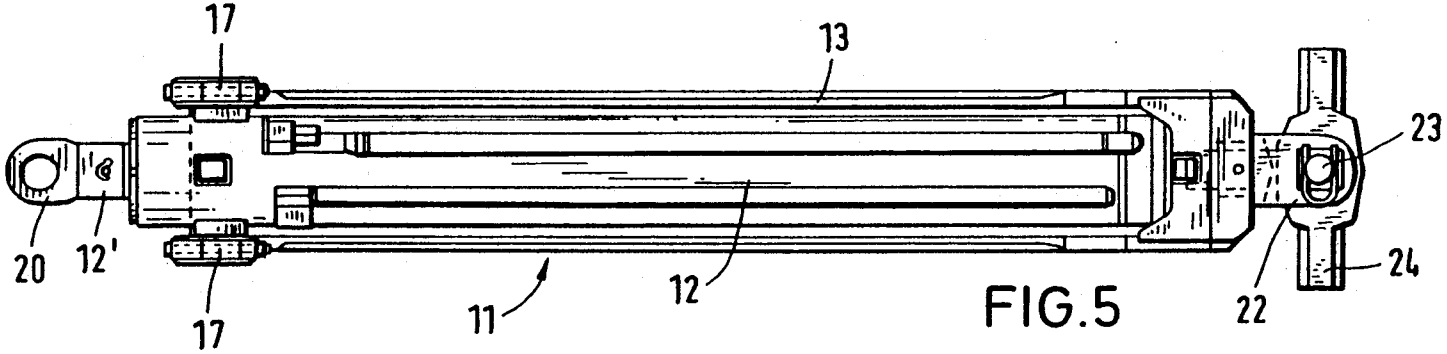
FIG. 5 is a plan view of the shifting mechanism shown in FIG. 4.
Figure 6:
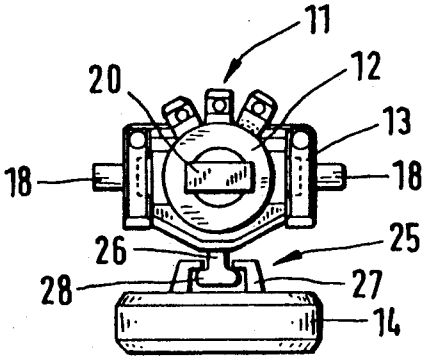
FIG. 6 is an end view of the shifting mechanism shown in FIGS. 4 and 5 and as viewed from the mineral face.

The space between the floor sills 2 accommodates a shifting mechanism 11 shown separately in FIGS. 4 to 6. As is known, the mechanism 11 is composed of a double-acting hydraulic ram 12 which is extendible or retractable in increments or steps, a trough 13 acting as a housing partly surrounding the ram 12 and a guide beam 14. The guide beam 14 is a flat plate which has a width approximately the same as the distance between the floor sills 2. The beam 14 is disposed beneath the trough 13 and rests on the floor.

The trough 13 is guided on the beam 14 in the direction of shifting. The front end of the beam 14 bears a head piece 15 which is connected to an abutment more usually a conveyor 16 extending along the working. The head piece 15 is preferably connected to the conveyor 16 with a universal joint permitting pivoting in vertical and horizontal senses.

As is known, a number of support frames with shifting mechanisms would be disposed side-by-side along the working and linked to individual channel sections of the conveyor 16.

The trough 13 has a U-shaped or channel shaped cross-section open from above. The trough 13 has its front end-nearest the conveyor 16 and the mineral face—equipped with a swivel bearing 17 for connection to the cylinder of the ram 12. For this purpose, a connector has two diametically—opposed pivot pins 18 which engage in apertures in the bearing 17. These apertures which are open from the top are closed off by detachable closures 19 such as bolts or the like. The piston rod 12' of the ram 12 is provided with a head piece 14 which is connected to a bracket 21 fitted to the guide beam 20. The bracket 21 is located centrally of the guide beam 14 so that sufficient space is left for the support of a device used for partially lifting the sills 2.

At the end of the trough 13 remote from the mineral face the trough 13 has an articulated joint 22 which connects with a vertical hinge pin 23 to a transverse Yoke 24. As shown in FIGS. 1 and 2, the yoke 24 is connected to the stowage or goaf end regions of the floor sills 2.

When the props 5 are set, so that the frame is rigid, the ram 12 can be charged with pressure fluid to cause the piston rod 12' to extend. As the rod 12' extends the beam 14 is forced to advance towards the mineral face and this urges the conveyor 16 towards the face. This situation is shown in FIGS. 1 and 2. When the props 5 are relieved however the ram 12 can be charged with pressure fluid to cause the piston rod 12' to retract and the ram 12 draws up the frame and the trough 13 along the guide beam 14.

Between the guide beam 14 and the trough 13 there is a longitudinal guide 25 which permits the guide beam 14 to move vertically to a limited extent and to pivot or tilt relative to the direction of advancement. The guide 25 can take the form of a T-shaped rail or bar 26 on the underside of the trough 3 and a guide element 27 such as a claw on the beam 14 into which a transverse head 28 of the rail 26 locates. As shown in FIG. 4 the rail 26 extends only part way along the trough 13 (14") while the guide element 27 extends right up to the stowage end (14') of the beam 14 and terminates at the front just clear of the bracket 21. The positions of the rail 26 and guide element 27 can be reversed from that illustrated with the rail 26 on the beam 14 and the guide element 27 on the trough 13.

The mutually guided parts 26,27 always locate one another regardless of the extension of retraction of the ram 12.

FIG. 6 shows particularly that the guide 25 is designed so that the beam 14 is given clearance in the vertical and transverse directions and the trough 13 and the beam 14 are adjustable relatively within certain limits. The objective is to keep the beam 14 on the floor even when the floor sills 2 are being pressed into the floor and are being partially lifted with the trough 13 to take up a slightly inclined orientation.

The sills 2 have a lifting device 29 by means of which the sills 2 can be partially lifted independently of one another. The device 29 employs two toggle levers 30 disposed parallel to one another and pivotable in a plane perpendicular to the mineral face. The levers 30 are pivotably supported to the sides of the sills 2 which face one another with the aid of pivot joints 30' with horizontal pivotal axes. The levers 30 are conveniently at the same level as the ram 12 and disposed a short distance in advance of the mineral-face-end of the trough 13. The lifting device 29 further comprises hydraulic piston-and-cylinder units 31 fitted with pivot joints 32 to the sills 2 above and to the sides of the ram 12. The units 31 are also connected with pivot joints 33 to the upwardly extending arms 34 of the toggle levers 30. The arrangement is such that when the units 31 are charged with pressure fluid either together or independently the associated levers 30 are forced to pivot anticlockwise and their other arms 35 engage on the beam 14. Preferably rollers 36 or the like on the ends of the arms 35 engage on the beam 14. As the levers 30 exert force on the beam 14, which rests on the floor, at least the front ends 2' of the sills 2 can be raised. The forces are reliably transferred directly to the floor via the guide beam 14. Preferably the units 31 are above the trough 13 and arranged as shown in FIGS. 2 and 3 well above the shifting mechanism while the levers 30 locate at the sides of the mechanism. The joints 30' lie on the mineral face end of the sills 2 in front of the trough 13 immediately above the beam 14.

It is important to ensure that the guide 25 provides adequate freedom between the trough 13 and the beam 14 so that throughout the shifting progress with its advancement and drawing-up phases there is no jamming or deformation of the guide parts even if the lifting device 29 is actuated. Furthermore the guide 25 should be arranged to allow free space either side to allow the levers 30 or the rollers 36 thereof to pass easily.

It is not strictly necessary to have the ram housing 13 connected to the ram 12 as depicted or indeed to have the housing 13 fabricated as a trough or U-shaped. For example, this housing component 13 can be replaced by a component with two longitudinal side walls at diametrically opposite sides of the cylinder of the ram 12 and cross-pieces joining the walls at the lower sides.

We claim:

1. A mine roof support frame comprising a roof-engaging structure, a floor-engaging structure, hydraulic props disposed between the roof and floor-engaged structures, a shifting mechanism with a guide beam and an hydraulic ram for displacing the frame; wherein the guide beam is connectible to a shiftable abutment, the floor-engaging structure is composed of a pair of side-by-side elongate sills spaced apart to produce a space therebetween with the shifting mechanism being located in the space between the floor sills, a housing is provided for the ram of the shifting mechanism and at least partly surrounds said ram, the guide beam is disposed beneath the ram housing and is positioned to rest on the floor of a mine working during use; independent guide means acting between the guide beam and the ram housing serves to guide the ram housing and the guide beam for relative movement predominantly longitudinally of the floor sills while permitting vertical and tilting adjustments between the guide beam and the ram housing, and respective connection means connects the ram to the ram housing for vertical displacement therewith and connects the ram to the guide beam whereby to maintain the guide beam in contact with the floor of the mine working.

2. A support frame according to claim 1 wherein the ram housing is a U-shaped trough open at the top.

3. A support frame according to claim 1, and further comprising a lifting device for partially lifting the floor sills when the frame is to be displaced by the shifting mechanism, the lifting device comprising at least one lever, means pivotably mounting the lever to one of the floor sills and a piston and cylinder unit for swinging the lever in a plane parallel to the floor sills to cause the lever to engage on the guide beam.

4. A support frame according to claim 3, wherein the lifting device comprises two levers and two associated piston and cylinder units each lever being pivotably mounted to a respective one of the floor sills.

5. A support frame according to claim 4, wherein the levers are positioned at the sides of the ram housing.

6. A support frame according to clam 4 wherein the levers are pivotably mounted to the floor sills with pivot joints in front of the ram housing relative to the direction of advancement.

7. A support frame according to claim 4 wherein the piston and cylinder units are disposed generally parallel to the floor sills and are connected to the floor sills with pivot joints.

8. A support frame according to claim 1, wherein the guide means comprises a guide rail partly received in a guide element with clearance therebetween, the guide rail and the guide element being positioned at the central region of the space between the floor sills.

9. A support frame according to claim 8 wherein the guide rail is mounted on the lower side of the ram housing and the guide element is mounted on the upper side of the guide beam.

10. A support frame according to claim 9 wherein the guide rail extends approximately half way along the bottom of the ram housing and the guide element approximately half way along the guide beam.

11. A support face according to claim 1 wherein the guide beam is a flat plate with a width substantially the same as the distance between the floor sills.

12. A support frame according to claim 1 wherein the connection means includes an upstanding bracket on the guide beam, a head piece on the piston rod of the ram and a pivot joint between the bracket and the head piece.

13. A support frame according to claim 12 wherein the connection means further comprises a swivel bearing on the ram housing and a connector mounted on the cylinder of the ram and having pivot pins engaging in the swivel bearing.

14. A support frame according to claim 12, and further comprising a lifting device for partially lifting the floor sills during displacement of the frame, the lifting device comprising a pair of levers, pivot joints mounting the levers to the floor sills, piston-and-cylinder units for swinging the levers about the pivot joints in planes parallel to the floor sills wherein the levers are located at the sides of the bracket and engage directly on the guide beam when the units are operated to effect partial lifting of the sills.

15. A support frame according to claim 1 and further comprising articulated joint means mounted on the ram housing and connected to the floor sills in a rear region thereof remote from the direction of advancement.

16. A mine roof support frame comprising a roof-engaging structure, a floor-engaging structure, hydraulic props disposed between the roof and floor-engaged structures, a shifting mechanism with a guide beam and an hydraulic ram for displacing the frame; wherein the guide beam is connectible to a shiftable abutment, the floor-engaging structure is composed of a pair of side-by-side elongate sills spaced apart to produce a space therebetween with the shifting mechanism being located in the space between the floor sills, a housing is provided for the ram of the shifting mechanism and at least partly surrounds said ram, the guide beam is disposed beneath the ram housing and is positioned to rest on the floor of a mine working during use; independent guide means acting between the guide beam and the ram housing serves to guide the ram housing and the guide beam for relative movement predominantly longitudinally of the floor sills while permitting vertical and tilting adjustments between the guide beam and the ram housing, and respective connection means connects the ram to the ram housing for vertical displacement therewith and connects the ram to the guide beam whereby to maintain the guide beam in contact with the floor of the mine working; wherein the guide means comprises a guide rail partly received in a guide element with clearance therebetween, the guide rail and the guide element being positioned at the central region of the space between the floor sills; and wherein the guide rail has a T-shaped cross section and the guide element engages around a crosspiece of the guide rail in the manner of a claw.

17. A mine roof support frame comprising a roof-engaging structure, a floor-engaging structure, hydraulic props disposed between the roof and floor-engaged structures, a shifting mechanism with a guide beam and an hydraulic ram for displacing the frame; wherein the guide beam is connectible to a shiftable abutment, the floor-engaging structure is composed of a pair of side-by-side elongate sills spaced apart to produce a space therebetween with the shifting mechanism being located in the space between the floor sills, a housing is provided for the ram of the shifting mechanism and at least partly surrounds said ram, the guide beam is disposed beneath the ram housing and is positioned to rest on the floor of a mine working during use; independent guide means acting between the guide beam and the ram housing serves to guide the ram housing and the guide beam for relative movement predominantly longitudinally of the floor sills while permitting vertical and tilting adjustments between the guide beam and the ram housing and respective connection means connects the ram to the ram housing, for vertical displacement therewith and connects the ram to the guide beam whereby to maintain the guide beam in contact with the floor of the mine working; wherein the guide means comprises a guide rail partly received in a guide element with clearance therebetween, the guide rail and the guide element being positioned at the central region of the space between the floor sills; the guide rail is mounted on the lower side of the ram housing and the guide element is mounted on the upper side of the guide beam, wherein the guide rail extends approximately half way along the bottom of the ram housing and the guide element approximately half way along the guide beam, and wherein the guide rail is disposed over the part of the ram housing at the front relative to the direction of advancement.

* * * * *